United States Patent [19]

Snyder

[11] 4,165,146

[45] Aug. 21, 1979

[54] RETENTION MEANS FOR SNAP-IN SPRING

[75] Inventor: Charles A. Snyder, Holland, Pa.

[73] Assignee: Circle F Industries, Inc., Trenton, N.J.

[21] Appl. No.: 874,738

[22] Filed: Feb. 3, 1978

[51] Int. Cl.[2] ..... H01R 13/00; G12B 9/00

[52] U.S. Cl. ..... 339/128; 248/27.3

[58] Field of Search ..... 339/17 D, 128, 122 R, 339/125 R, 126 R; 248/27.1, 27.3, 56, DIG. 6; 85/85; 220/3.9; 285/162

[56] References Cited

U.S. PATENT DOCUMENTS 2,889,125 6/1959 Hart ..... 248/27.3

*Primary Examiner*—Joseph H. McGlynn
*Assistant Examiner*—John S. Brown
*Attorney, Agent, or Firm*—Albert Sperry; Frederick A. Zoda; John J. Kane

[57] ABSTRACT

An electrical wiring device, which may be an incandescent lamp socket, receptacle, switch, pilot light or any other wiring device intended for mounting in an opening of a metal sheet, has a mounting means of the snap-in spring type, including divergent spring arms formed with sheet engaging elements on their free ends, that have serrations adapted to engage opposed corners of the mounting opening formed in the metal sheet or plate in which the wiring device is to be supported. The serrations differ from conventional types used in springs of this type in that the portion of the spring arm in which the serrations are formed has a centrally depressed area which offsets inwardly, from the general plane of the teeth, all but the side edge portions of the portion of the spring arm in which the serrations are formed. The serrations are limited to the side edge portions rather than extending fully across the width of the spring arm as has been conventional practice, thus to promote retention of an accurate, sharp, serration. Use of a high tensile strength steel, that does not require tempering and hardening as a final production step, is made feasible by the invention.

3 Claims, 6 Drawing Figures

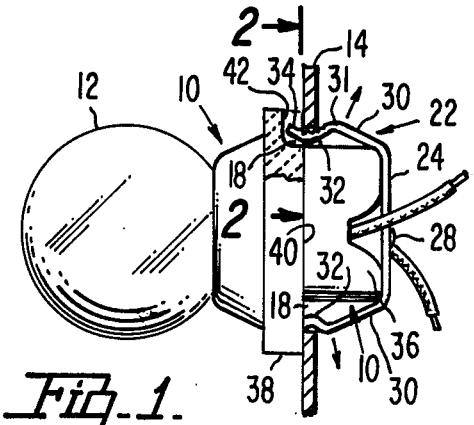
Fig. 1.
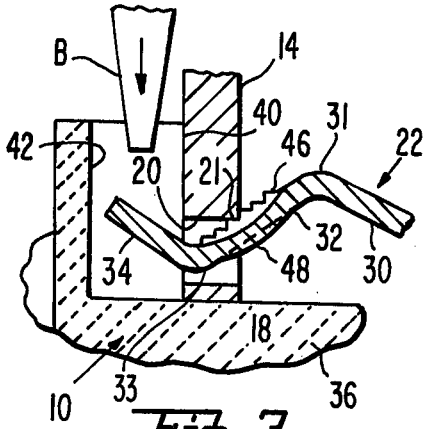
Fig. 3.
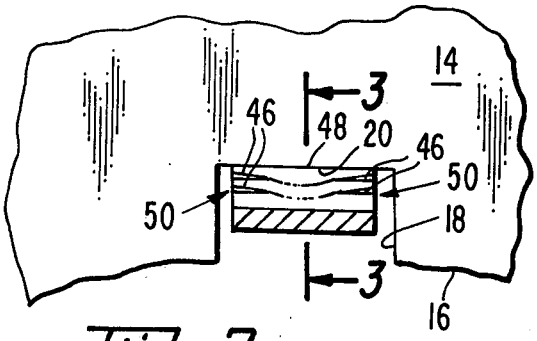
Fig. 2.
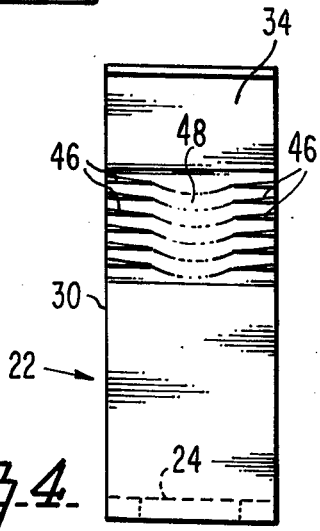
Fig. 4.
Fig. 5.
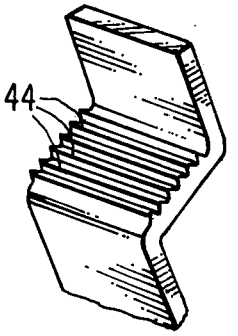
CONVENTIONAL
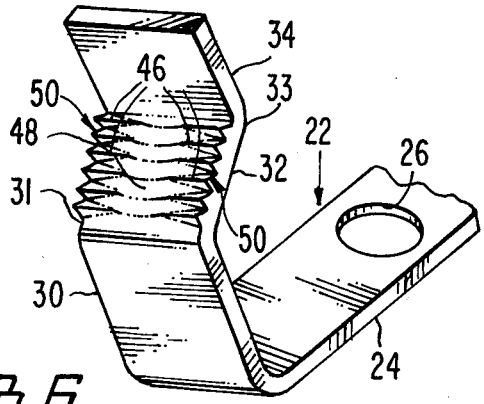
Fig. 6.

RETENTION MEANS FOR SNAP-IN SPRING

BACKGROUND OF THE INVENTION

1. Field of the Invention

The invention falls generally in the field of mounting means for wiring devices. In a more particular sense, the invention may be considered as falling into that class of mounts for wiring devices wherein the devices are pushed into mounting openings provided for the purpose, placing mounting arms of spring material under tension, with the mounting arms ultimately springing into abutting engagement with the opposed corners of the mounting opening when the wiring device ultimately is pushed home.

Mounting means of this type are generally incorporated on wiring devices of the so-called OEM ("original equipment manufacturere") type, where they are commonly used as labor-saving and time-saving mounts, enabling quick assembly of switches, receptacles, incandescent lamp sockets and the like with the metal plates of stoves, ovens, refrigerators, etc.

2. Description of the Prior Art

It is well known in the prior art to utilize snap-in mounting springs on wiring devices of the general types described above. Normally the mounting springs are made in a single piece of strip metal material, having suitable spring characteristics. However, it is not unknown to provide mounting springs that are in actuality comprised of separate, opposed spring arms. In either instance, it is conventional practice to first form the piece in a progressive die from, for example, AISI C1050 cold rolled annealed spring steel. Then, the completed piece is hardened and tempered in a final production step that has added considerably to the manufacturing cost.

In either type, the mounting means incorporates a pair of opposed, opposite but identical spring arms which are normally extended in diverging relation, and have free end portions that are inwardly offset and are formed with reentrant angles. In one portion of the reentrant angle formations of the spring arms, transverse series of serrations are provided. When the mounting spring is pressed into the mounting opening, the arms are initially placed under tension, but when the wiring device is pushed home, the arms are freed to spring outwardly, in such fashion that the formed angle and serrations grip the opposed corners of the mounting opening, thereby securely and fixedly retaining the mounting device in its proper, mounted position in the metal plate of the stove, range hood, medicine cabinet, or other appliance in which the wiring device is to be mounted.

In the prior art, difficulties have been experienced in the use of mounting springs of the type described. These difficulties arise, in many instances, due to hydrogen embrittlement.

Also, in the prior art the cost has been increased substantially by the necessity of a separate hardening and tempering process of the pieces after they are formed.

It has been found, in using high-tensile spring steels that are inherently of a temper and strength sufficient to dispense with the conventional hardening step, that there is a great tendency in the snap-in spring forming tools, to break or crack the piece at the location of the serrations. The serrations are formed in the spring metal strips by punches or equivalent inserts provided in the dies. When serrations are formed extending across the full width of the metal strip, such inserts or punches wear rapidly, and the piece parts tend to come out of the die with serrations that are not sharply V-shaped, often representing little more than grooves extending across the spring-metal part. These, obviously, do not have the gripping capacity that is necessary for spring mounts of the type described, and fail to meet customer's specifications. Indeed, in such instances the wiring device may tend to fall out of the mounting opening after a period of time, during normal use of the appliance, and this not only is productive of customer complaints, but even can represent fire hazards or other safety hazards.

One solution to at least part of these problems, relating to the cost of hardening and tempering the completed production parts, is to use a specially constituted steel that does not require the separate hardening step. This has not heretofore been possible due to rupture of the part in the die when such materials are used.

SUMMARY OF THE INVENTION

Summarized briefly, the invention comprises a push-in mounting spring means which, so far as its overall general configuration is concerned, is basically conventional. However, in accordance with the invention, the gripping serrations of the opposed spring arms of the mounting means are not extended over the full width of the spring arms, as has been the conventional practice. Rather, the portion of each spring arm in which the serrations are formed is depressed out of the general plane in which the serrations would normally extend across the full width of the arm, so that the serrations are confined to the side areas at opposite sides of the depressed, inwardly offset part.

As a result, in each spring arm, instead of serrations extending across the full width thereof, there are provided opposed side edge areas, that are serrated, and that flank an inwardly offset smooth area that is so formed as to be prevented from engaging the edge of the mounting opening provided for the wiring device.

At the same time, the provision of opposed series of serrations, limited to the side edge portions of the spring arms, has the further desirable effect of promoting effective gripping of the opposed corners of the mounting opening in which the wiring device is to be mounted. This is achieved by reason of the fact that the straight edges normally gripped by the serrations, are engaged at locations spaced apart along said edges of the mounting opening. It thus becomes immaterial whether the edge of the mounting opening has burrs, or is out of parallel with the general plane of the spring arm, or is formed other than perfectly straight. Most of these defects become relatively immaterial when a mounting spring formed in accordance with the present invention is utilized.

Most importantly, when the serrations are formed in the manner described above, they permit the piece to be made of a high-tensile-strength spring steel of a type that does not require heat-treating as a final production step, thus disposing of the hydrogen embrittlement problem and its resultant safety hazard.

BRIEF DESCRIPTION OF THE DRAWING

FIG. 1 is a view partly in side elevation and partly in section of a wiring device equipped with the snap-in mounting spring constructed according to the present invention, the wiring device in this instance being an incandescent lamp socket, the device being shown mounted in the opening of a metal plate of an appliance such as the wall of an oven;

FIG. 2 is an enlarged, detail sectional view taken substantially on line 2—2 of FIG. 1, illustrating a portion of the edge of the mounting opening of the plate, and further illustrating the engagement of said edge by the serrations of the mounting spring comprising the present invention;

FIG. 3 is a detail sectional view, on the same scale as FIG. 2, taken substantially on line 3—3 of FIG. 2, a screwdriver bit being illustrated fragmentarily as it would appear when the wiring device is to be removed from the mounting opening;

FIG. 4 is an end elevational view of the mounting spring per se, on the same scale as FIGS. 2 and 3;

FIG. 5 is a fragmentary perspective view of a conventional mounting spring illustrating serrations formed in the conventional fashion, extending across the full width of the spring; and FIG. 6 is a view like FIG. 5, showing serrations formed in the mounting spring in accordance with the present invention.

DESCRIPTION OF THE PREFERRED EMBODIMENT

Generally designated at 10 is an electrical wiring device. In the illustrated example, there has been shown a snap-in porcelain lamp holder used for mounting of an incandescent lamp 12 in one of the vertical walls of a kitchen oven or the like, having a wall 14 formed with a circular mounting opening 16 provided at diametrically opposite locations with rectangular mounting recesses 18 each of which has a straight back edge 20 formed with a corner 21 that is engaged by serrations formed upon the outwardly facing surfaces of opposed spring arms of the snap-in mounting spring 22 incorporated as a part of the lamp holder.

The mounting clip or spring 22 in the illustrated example is of the so-called "wrap-around" type, that is, it comprises a single strip of spring metal material, of approximate U-shape, having a bight or base portion 24 formed with a centrally located opening 26 adapted to receive a rivet 28, that connects the spring steel mounting clip to the base or bottom portion of the wiring device, in position such that the opposed spring arms 30 integral with the opposite ends of the base portion 24, will extend forwardly along the diametrically opposite sides of the body of the wiring device.

Insofar as the general configuration of each spring arm 30 is concerned, this does not depart from conventional shapes found acceptable and efficient in the art. Thus, the spring arms 30 diverge forwardly from the base of the wiring device, as best shown in FIG. 1, and short of the forwardly projecting, free extremities, said arms are bent inwardly along transversely extending lines 31 to define gripping portions that engage the corners 21 of the mounting opening 16 of plate 14. The gripping portions 32 of the opposed spring arms converge in a forward direction, and in turn merge, along bend lines 33, into forwardly divergent tongues 34 disposed at the distal extremities of the respective spring arms 30.

The material used, preferably, is a high-tensile-strength spring steel that does not require heat-treating after the piece has been formed. I propose to use, for example, the material known as "MartINsite", a product of the Inland Steel Company.

As noted above, this shape of the spring arms, wherein the spring arms have main, forwardly divergent portions merging into forwardly converging gripping portions 32, which in turn merge into forwardly divergent distal extremities 34, is already known in the art. It is also known in the art to provide a series of serrations on the outer surface of each of the gripping portions 32, said serrations extending across the full width of the portions 32 as shown in FIG. 5. This shape cannot be impressed into a steel such as "MartINsite" without cracking or rupture at the location of the serrations.

At this time, it may be noted that regardless of the particular type of wiring device in which the mounting means is incorporated, said device will in every instance include a body 36, which in the illustrated example is of circular form and is of porcelain material. It will be understood, however, that said body may very well be of a plastic material, may be rectangular other than of circular cross section, or may be of still other material and shapes, according to the particular type of wiring device in which the mounting spring is to be incorporated.

Typically, however, every wiring device in which mounting spring means of this type is used, has a mounting flange 38, formed with a rearwardly facing shoulder 40, in diametrically opposed portions of which there are formed outwardly opening recesses 42 loosely receiving the tongues 34. The tongue receiving recesses 42 of the wiring device are designed to permit free flexure of the arms of the mounting clip, so that the clip arms can deflect inwardly while the wiring device is being pushed into the opening, and then are free to spring outwardly when the shoulder 40 ultimately engages the surface of the mounting plate 14. In the circumstances, the serrations 44 conventionally provided (see FIG. 5) in portion 32 of the clip will grip the corner 21, and will maintain the gripping engagement with the corner by reason of the outwardly directed spring tension of the respective arms of the clip. Said arms are tensioned to normally spring outwardly in the direction of the arrows shown in FIG. 1, after the wiring device is pushed into the mounting plate in a left to right direction, viewing the same as in FIG. 1.

In any event, once the wiring device has been pushed home with its shoulder 40 in face-to-face contact with the mounting plate 14, it will normally remain permanently engaged in the mounting opening, unless and until it is necessary to remove the wiring device for replacement or repair. In such event, it is conventional practice to utilize the bit of a screwdriver or the like, which enters one or the other of the side recesses 42 of the wiring device, and which engages tongue 34, deflecting the tongue inwardly, to disengage the teeth from the edge 20, thereby to free the wiring device for removal. Normally, however, the wiring device remains permanently installed.

Conventional serrations have been illustrated in FIG. 5, at 44. Serrations of the FIG. 5 variety cannot be formed in a steel having, inherently, a very high tensile strength, such as "MartINsite".

In accordance with the present invention, and referring particularly to FIG. 6, instead of having the serrations 44 extending fully across the width of the portions 32, they are confined only to the side, that is, the longitudinal edge areas of said portions 32 as shown at 46 in FIGS. 4 and 6. This is achieved by providing, in the die or equivalent tool used for forming the mounting clips, a punch that depresses the central area of each portion 32, as at 48, to move it inwardly, out of the general plane of the serrations 46 (note FIG. 3). The inwardly offset portion 48 having been formed at one stage of manufacture of the clip in a progressive die, the serrations 46 can be formed in the next stage, and even though the serration-forming insert or punch of the die may extend across the full width of the clip, the serrations will be confined only to the longitudinal or side edge areas of the portion 32, and will merge into and will disappear gradually into the inwardly depressed area 48.

By reason of this formation, identical but opposite, longitudinally extending series 50 of gripping serrations 46 are formed upon the respective longitudinal edges of the forwardly convergent gripping portions of the opposed spring arms 30, and between the series 50, 50 of each portion 32 there is an inwardly offset area disposed wholly out of the plane of the serrations of the respective series or rows 50, 50 of the serrations.

This arrangement also produces a pairing of each serration 46 of a row 50 with a corresponding serration 46 of the other row 50 disposed at the opposite side of the depressed area of the same gripping portion 32. The paired serrations 46 grip the corner 21, and it becomes immaterial whether said corner 21 may have an intervening burr in the area of edge 20 coincident with the depressed midwidth portion 48 of the spring arm. Normally, paired teeth 46 of the opposed rows 50 of each gripping portion 32 will grip the corner 21 without difficulty, despite these various defects in the form of the edges of the mounting opening.

Further the construction illustrated and described can be applied with equal ease and efficiency both to annealed steels that have required heat-treating to harden and temper the completed piece, and to low-carbon, high-tensile-strength, cold-rolled, autotempered martensitic steels such as that heretofore described. In either instance the same serration form can be used, in the same progressive dies, with little die adjustment being required when transferring from one type of steel to the other.

I claim:

1. In a mounting spring clip means for an electrical wiring device of the type adapted to snap into and grip opposed edges of a wiring-device-receiving mounting opening of a mounting plate, said clip means including divergent spring arms resiliently, yieldably opposing movement toward each other, convergent gripping portions on the divergent ends of the spring arms, and transversely extending gripping means on said convergent portions, said spring arms being in embracing relation to the wiring device to be mounted, the improvement comprising serrations defining said gripping means, the serrations of each gripping portion being confined to opposed longitudinal edges of said gripping portion, the serrations extending along the opposite longitudinal edges of said gripping portion being arranged in rows, the serrations of each row extending transversely of the length of the row, each serration of a row having its length aligned with a corresponding serration of the other row, said gripping portion having a shallowly dished, inwardly offset midwidth area intervening between the rows of serrations, the serrations of each row merging smoothly into and disappearing within said depressed area at the edge of said depressed area.

2. In a mounting spring clip means for an electrical wiring device of the type adapted to snap into and grip opposed edges of a wiring-device-receiving mounting opening of a mounting plate, said clip means including divergent spring arms resiliently, yieldably opposing movement toward each other, convergent gripping portions on the divergent ends of the spring arms, and transversely extending gripping means on said convergent portions, said spring arms being in embracing relation to the wiring device to be mounted, the improvement comprising serrations defining said gripping means, the serrations of each gripping portion being confined to opposed longitudinal edges of said gripping portion, said serrations being arranged in two longitudinally extending rows, said rows extending along the opposed longitudinal edges of each gripping portion, each of said gripping portions having a midwidth area between the rows of serrations thereof, said midwidth area being free of serrations and being devoid of any surfaces disposed in the general plane of the serrations of the respective rows, the midwidth area being defined by a depressed part of said gripping portion, said depressed part being integrally joined with and merging into each serration of the respective rows.

3. The improvement of claim 2 wherein said depressed part is offset inwardly out of the general plane of the serrations of the respective rows of the gripping portion.

* * * * *